US006499188B1

(12) United States Patent
Cheng

(10) Patent No.: US 6,499,188 B1
(45) Date of Patent: Dec. 31, 2002

(54) CASE HINGE STRUCTURE

(76) Inventor: Chun Lung Cheng, 1786 Curtiss Ct., La Veine, CA (US) 91750

( * ) Notice: Subject to any disclaimer, the term of this patent is extended or adjusted under 35 U.S.C. 154(b) by 72 days.

(21) Appl. No.: 09/688,430

(22) Filed: Oct. 17, 2000

(51) Int. Cl.[7] ..... E05D 1/06
(52) U.S. Cl. ..... 16/269; 16/225; 16/355
(58) Field of Search ..... 16/269, 342, 350, 16/355, 252, 225; D8/327

(56) References Cited

U.S. PATENT DOCUMENTS

| | | | | | |
|---|---|---|---|---|---|
| 1,734,810 | A | * | 11/1929 | Jeffers | 16/269 |
| 2,302,661 | A | * | 11/1942 | Benson | 16/355 |
| 3,242,523 | A | * | 3/1966 | Daley | 16/269 |
| 3,814,220 | A | * | 6/1974 | Brody | 190/19 |
| 4,852,213 | A | * | 8/1989 | Shewchuk | 16/269 |
| 5,329,667 | A | * | 7/1994 | Erskine | 16/269 |
| 5,622,012 | A | * | 4/1997 | Schijf | 16/355 |
| 5,915,446 | A | * | 6/1999 | De Zen | 16/269 |

* cited by examiner

*Primary Examiner*—Lynne H. Browne
*Assistant Examiner*—Doug Hutton
(74) *Attorney, Agent, or Firm*—Raymond Y. Chan; David and Raymond Patent Group

(57) ABSTRACT

A case hinge structure is adapted for installing on a case which includes a case body having a rear panel and a case cover having a rear wall wherein the hinge structure is affixed between the rear panel of the case body and the rear wall of the case cover in such a manner that the case cover is adapted for pivotally folding from a closed position to an open position. In the closed position, the case cover is tightly cover on top of the case body, and in the open position, the case cover is pivotally folded up at a predetermined folding angle with respect to the case body. The hinge structure includes a lower joint, which is affixed to the rear panel, including a supporting arm having a C-shaped cross-section and defined a mounting slot therein, and an upper joint, which is affixed to the rear wall, having a pivot arm rotatably and coaxially received in the mounting slot of the lower joint in such a manner a mutual friction is provided between an outer circumferential surface of the pivot arm and an inner circumferential surface of the supporting arm, so as to frictionally adjust the folding angle of the case cover when opening the case.

14 Claims, 5 Drawing Sheets

CASE HINGE STRUCTURE

BACKGROUND OF THE PRESENT INVENTION

1. Field of Invention

The present invention relates to a hinge, and particularly to a case hinge structure which is adapted for selectively adjusting a folding angle A of the case's cover. Thus, the case hinge structure is mounted inside the case in order to protect the hinge structure for extending the service life span of the case and keep an aesthetic appearance of the case.

2. Description of Related Arts

Traditionally, a case 1 comprises a case body 1A and a case cover 1B pivotally connected to the case body 1A by means of a hinge 2, as shown in FIG. 1, wherein the hinge 2 comprises a pair of metal panels 3, 4 each having a pin slot affixed on exterior surfaces of the case body 1A and the case cover 1B respectively, and a pin 5 coaxially inserted into the pin slots of the two metal panels 3, 4 in such a manner that the case cover 1B is adapted for pivotally rotating so as to open up the case 1. However, such traditional hinge 2 has the following drawbacks:

(1) A user can only fold the case 1 cover 180 degrees from a closed position to an open position such that the user cannot adjust a folding angle A of the case cover 1B, which is inconvenient for the user since the user may not able to keep the balance of the case 1 when opening the case 1. In order to keep the case cover 1B in a desired folding angle A, a pivot arm 6 is affixed between the case body 1A and the case cover 1B, as shown in FIG. 2. However, the manufacturing cost of the case 1 will be increased by adding parts into the case 1.

(2) Since the hinge 2 is affixed on the exterior bottom surface of the case 1, when the user carries the case 1, the hinge 2 may accidentally or unintentionally be damaged by collusions or mutual friction of the floor. Thus, the hinge 2 may destroy the aesthetic appearance of the case 1 as well.

(3) The pin 5 must be strong enough to pivotally connect the case body 1A and the case cover 1B together. Due to the external collusion and the mutual friction of the metal panels 3, 4, the pin 5 may easy to worn out. So, when the pin 5 is broken, which is non-replaceable, the case 1 must be thrown away that is a waste of source.

(4) The metal panels 3, 4 of the hinge 2 is affixed on the case 1 by means of rivets, which will damage the surface of the case 1, destroy the beauty appearance of the case 1, and increase the manufacturing cost of the case 1.

(5) The case cover 1B is hard to tightly cover on top of the case body 1A due to the manufacturing deflection of the hinge 2. So, dust or rain may enter into the case 1 from a gap between the case body 1A and the case cover 1B.

SUMMARY OF THE PRESENT INVENTION

A main object of the present invention is to provide a case hinge structure wherein the hinge structure is installed inside the case in order to protect the hinge structure, so as to extend the service life span of the case.

Another object of the present invention is to provide a case hinge structure wherein no pin or axle is needed in the pivot connection of the hinge structure, so as to prevent the pin or axle from being broken, which is the major and most easiest broken part of the conventional hinge structure.

Another object of the present invention is to provide a case hinge structure which is adapted to selectively adjust a folding angle A of its case cover, such that the case can be easily kept its balance.

Another object of the present invention is to provide a case hinge structure which is capable of tightly connecting the case cover with the case body together, so as to prevent a slit formed therebetween.

Another object of the present invention is to provide a case hinge structure which can keep an aesthetic appearance of the case since the hinge structure is inconspicuous and cannot be seen from outside.

Another object of present invention is to provide a case hinge structure wherein the case does not require to alter its original structural design so as to minimize the manufacturing cost of the case incorporating with the hinge structure.

Accordingly, in order to accomplish the above objects, the present invention provides a case hinge structure adapted for installing into a case, which comprises:

a case body having a box shape comprising a rear panel; and a case cover comprising a rear wall wherein the hinge structure is affixed between the rear panel of the case body and the rear wall of the case cover in such a manner that the case cover is adapted for pivotally folding from a closed position to an open position, wherein in the closed position, the case cover is tightly cover on top of the case body, and in the open position, the case cover is pivotally folded up at a predetermined folding angle with respect to the case body;

the hinge structure comprising:

a lower joint, which is upwardly extended from the rear panel of the case body, comprising a supporting arm having a C-shaped cross-section defined a mounting slot therein; and an upper joint, which is downwardly extended from the rear wall of the case cover, having a pivot arm rotatably and coaxially received in the mounting slot of the lower joint in such a manner a mutual friction is provided between the pivot arm and the supporting arm so as to adjust the folding angle of the case cover when opening the case.

DETAILED DESCRIPTION OF THE PREFERRED EMBODIMENT

Figure 1:
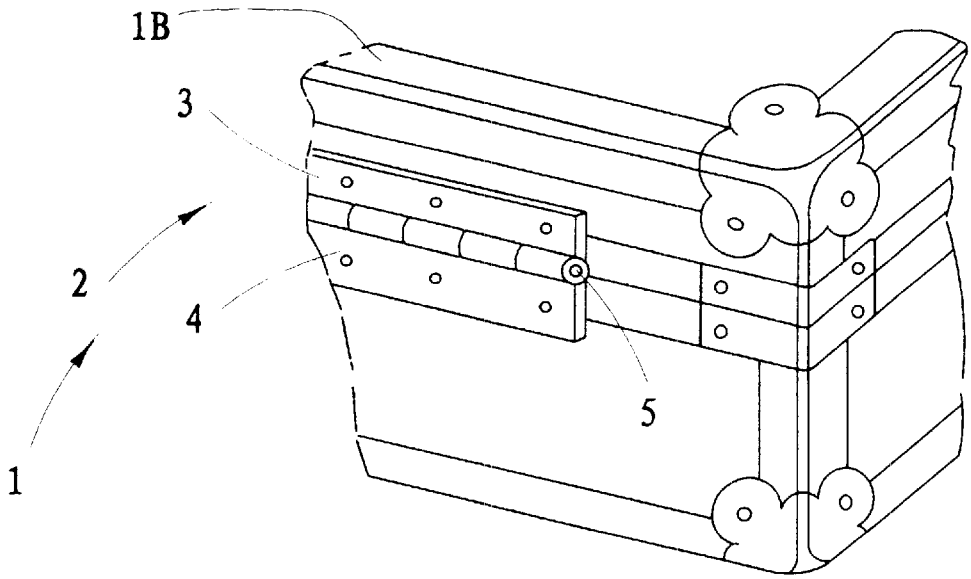
FIG. 1 is a perspective view of a conventional hinge structure installed into a case.
Figure 2:
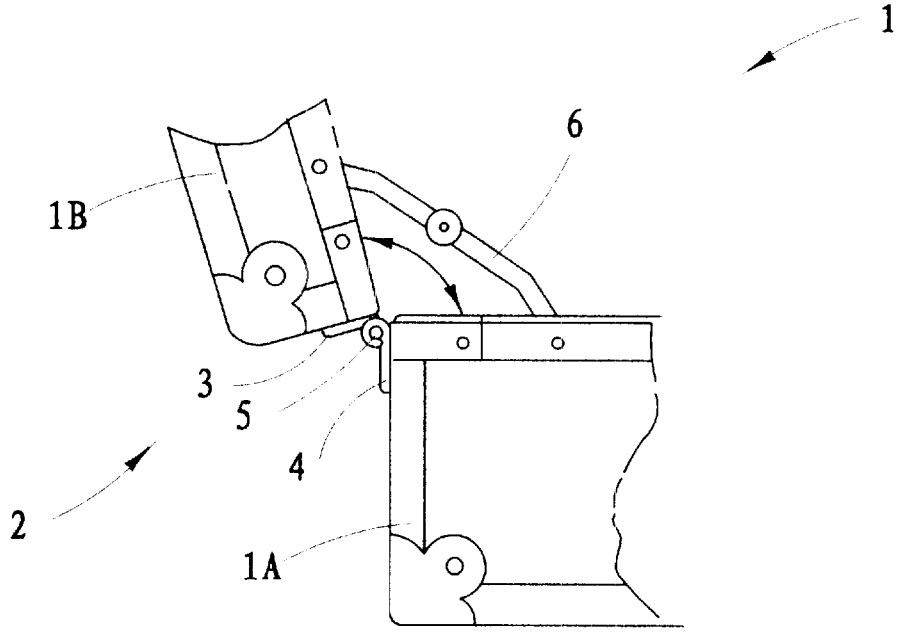
FIG. 2 is a perspective view of the conventional hinge structure incorporated with a pivot arm.
Figure 3:
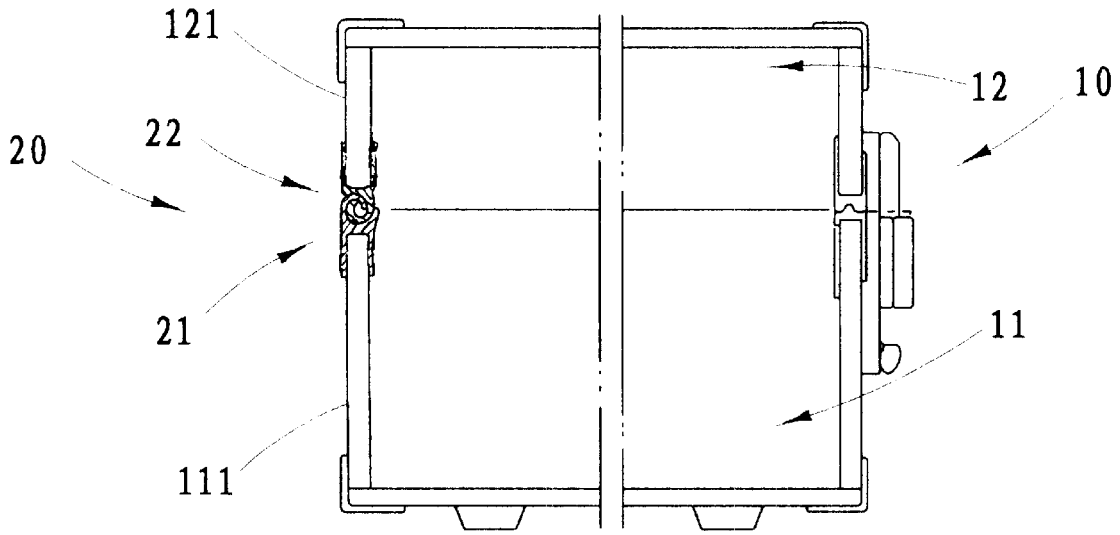
FIG. 3 is a partially sectional view of a case hinge structure according to a preferred embodiment of the present invention.

Referring to FIG. 3 of the drawings, a case hinge structure 20 according to a preferred embodiment of the present invention is illustrated wherein a case 10 is adapted for incorporating with the case hinge structure 20. The case 10 comprises a case body 11 having a box shape comprising a rear panel 111 a case cover 12 comprising a rear wall 121wherein the hinge structure 20 is affixed between the rear panel 111 of the case body 11 and the rear wall 121 of the case cover 12 in such a manner that the case cover 12 is adapted for pivotally folding from a closed position to an open position. In the closed position, the case cover 12 is tightly cover on top of the case body 11, and in the open position, the case cover 12 is pivotally folded up at a predetermined folding angle A with respect to the case body 11.

Figure 5:
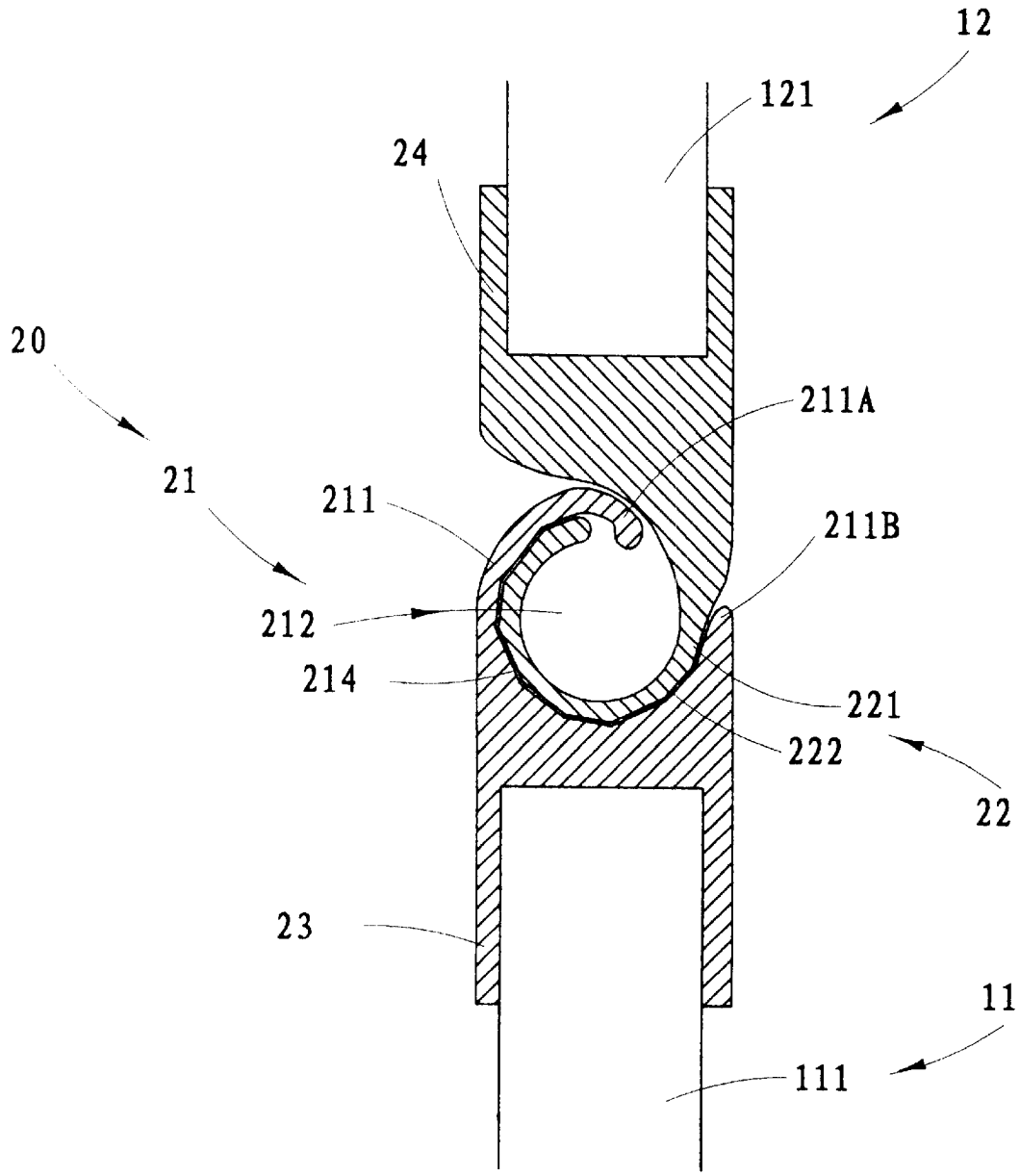
FIG. 5 is a side view of the case hinge structure in an open position according to the above preferred embodiment of the present invention.

As shown in FIG. 5, the hinge structure 20 has a lower joint 21 and an upper joint 22 rotatably connected to the lower joint 21 of the hinge structure 20 wherein the lower joint 21 and the upper joint 22 are made of durable material such as metal or plastic. The lower joint 21, which is upwardly extended from the rear panel 111 of the case body 11, has a supporting arm 211 having a C-shaped cross section defined a mounting slot 212 therein. The upper joint 22, which is downwardly extended from the rear wall 121 of the case cover 12, has a pivot arm 221 rotatably and coaxially received in the mounting slot 211 of the lower joint 21 of the hinge structure 20, so as to pivotally connect the case cover 12 with the case body 11 in such a manner that a mutual friction is provided between an outer circumferential surface the pivot arm 221 and an inner circumferential surface of the supporting arm 211 so as to adjust the folding angle A of the case cover 12 when opening the case 10.

Figure 4:
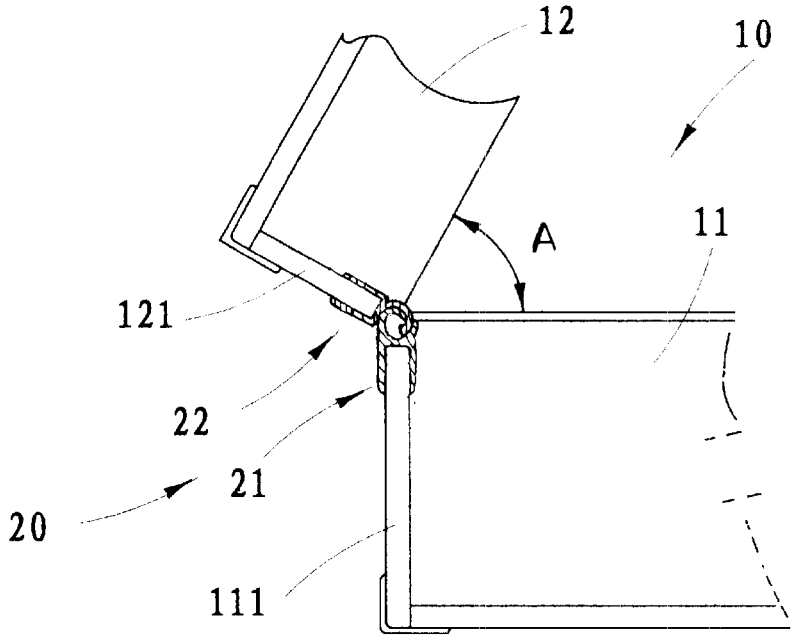
FIG. 4 is an enlarged sectional view of the case hinge structure according to the above preferred embodiment of present invention.
Figure 6:
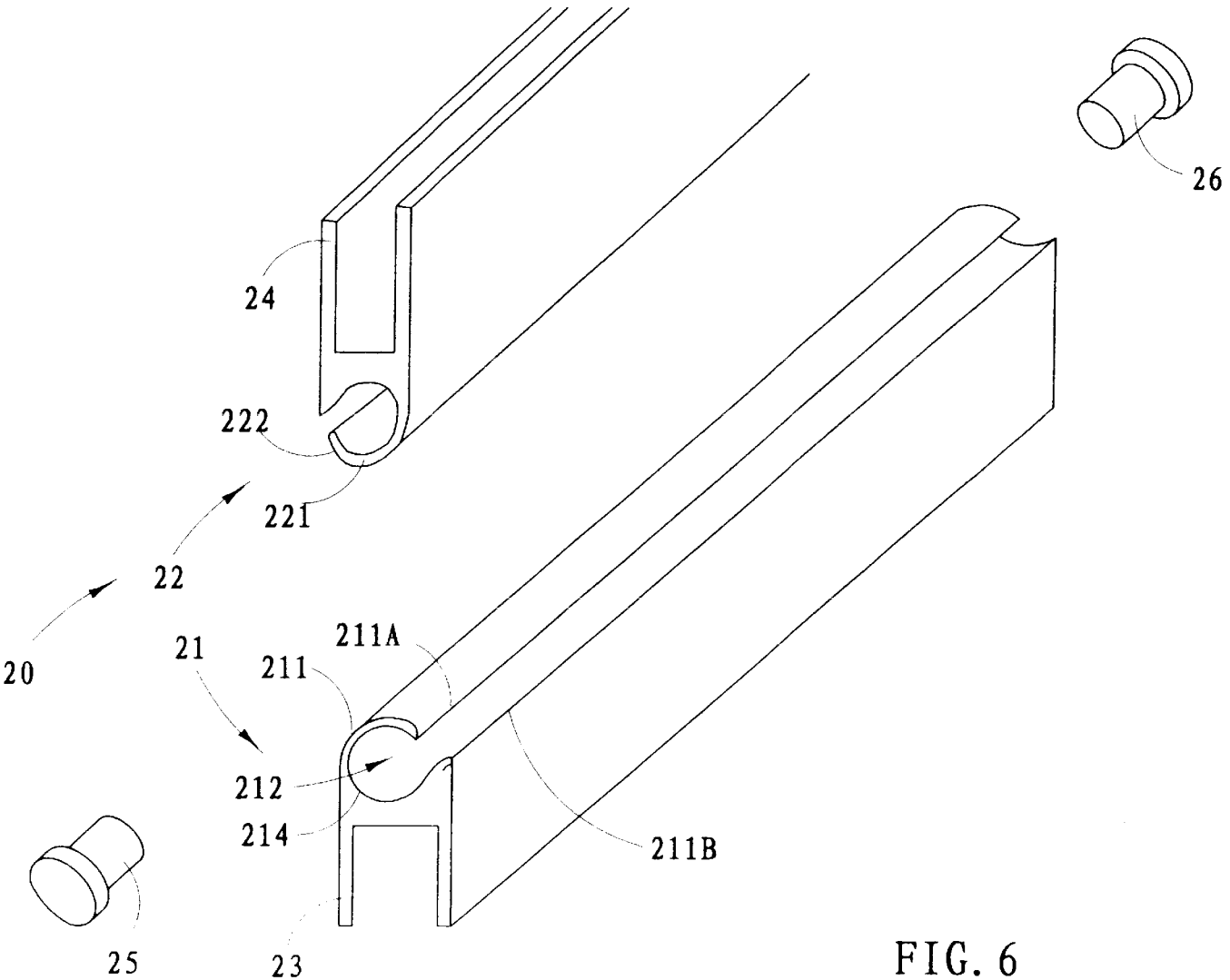
FIG. 6 is an exploded perspective view of the case hinge structure according to the above preferred embodiment of the present invention.

As shown in FIGS. 4, 5 and 6, the supporting arm 211 of the lower joint 21 of the hinge structure 20 has an upper edge 211A and a lower edge 211B, for blocking up the rotation of the case cover 12 in the open position and the closed position respectively, so as to limit the folding angle A of the case cover 12. The lower joint 21 further comprises a plurality of locking surfaces 214 integrally provided on the inner circumferential surface of the supporting arm 211 so as to form a polygon of the mounting slot 212.

The pivot arm 221 of the upper joint 22 of the hinge structure 20, according to the preferred embodiment, having an inversed C-shaped cross section is rotatably received in the mounting slot 212 wherein an outer diameter of the pivot arm 221 is slightly smaller than an inner diameter of the supporting arm 211. The upper joint 22 further comprises a plurality of driving surfaces 222 coaxially provided on the outer circumferential surface of the pivot arm 221 wherein the driving surface surfaces 222 are adapted for engaging with the respective locking surfaces 214, so as to lock up the case cover 12 at the desired folding angle A with respect to the case body 11.

In other words, when the case cover 12 is pivotally rotated upward for opening the case 10, the driving surfaces 222 are rotatably driven to engage with the locking surfaces 214 in order to provide a mutual friction therebetween such that the case cover 12 is frictionally locked up in such a rotatably movable manner, as shown in FIG. 5.

The various folding angles A of the case cover 12 are predetermined by how many locking surfaces 214 provided on the supporting arm 211. For example, when there are three locking surfaces 214 are provided on the supporting arm 211, three different folding angles A of the case cover 12 can be frictionally held with respect to the case body 11 such that the user is able to pivotally open the case 10 at different desired folding angles A.

In order to mount the upper joint 22 and the lower joint 21 to the case cover 12 and the case body 11 respectively, the hinge structure 20 further comprises a first affixing means 23 and a second affixing means 24 integrally extended from the lower joint 21 and the upper joint 22 respectively. The first affixing means 23 having a U-shaped cross section is downwardly extended from the lower joint 21 wherein the rear panel 11 of the case body 11 is substantially sandwiched therebetween. The second affixing means 24 also having a U-shaped cross section is upwardly extended from the upper joint 22 in such a manner that the rear wall 121 of the case cover 12 is substantially affixed thereto. In other words, the first and second affixing means 23, 24 are securely clamped on edges of the rear panel 111 and the rear wall 121 respectively. Thus, rivets can be mounted on the first and second affixing means 23, 24 penetrating through the rear panel 111 and the rear wall 121 respectively, so as to further securely affix the upper joint 21 and the lower joint 22 to the case cover 12 and the case body 11 respectively.

In order to connect the case cover 12 with the case body 11, the pivot arm 221 of the upper joint 22 is adapted to coaxially insert into the mounting slot 212 of the lower joint 21 from one side end thereof in such a slidably movable manner. So, no pin or axle is needed in order to pivotally connect between the case body 11 and case cover 12. Thus, the hinge structure 20 is inconspicuous and cannot be seen from an exterior of the case 10 such that the hinge structure 20 is well protected by the supporting arm 211. Furthermore, since the upper joint 22 and the lower joint 21 are fittedly engaged each other, the case cover 12 is capable of tightly covering on the case body 11, so as to minimize a gap between the case cover 12 and the case body 11, which can prevent the dust and water from entering into the case 10.

Moreover, the hinge structure 20 further comprises a pair of stoppers 25, 26 for coaxially mounting on two side ends of the lower joint 21 when the upper joint 22 is engaged therewith, so as to prevent a lateral movement of the pivot arm 221 of the upper joint 22 along the mounting slot 212.

As shown in FIG. 5, when opening the case 10, the pivot arm 221 of the upper joint 22 is coaxially rotated in the mounting slot 212, so as to upwardly and pivotally fold the case cover 12. It is worth to mention that the lower edge 211B of the supporting arm 211 will urge against the upper joint 22 in the closed position, and the upper edge 211A of the supporting arm 211 will urge against the upper joint 22 in the fully open position, so as to limit the folding angle A of the case cover 12. In other words, when a distance between the upper edge 211A and the lower edge 211B of the supporting arm 211 is lengthened, the case cover 12 is adapted for pivotally folding with larger folding angle A such that the folding angle A of the case cover 12 can be selectively adjusted by the width of the upper edge 211A and the lower edge 211B of the supporting arm 211 while manufacturing.

Moreover, the user can selectively fold up the case cover 12 in the desired folding angle A since the case cover 12 is frictionally held by the mutual friction between the locking surfaces 214 and the driving surfaces 222 engaged with each other such that the case cover 12 can be held at, for example, 30 degrees, 60 degrees, or even 120 degrees of the folding angle A with respect to the case body 11. The user can pivotally pull the case cover 12 such that the driving surface 222 will be forced to disengage with the respective locking surface 214 and then re-engage with the neighboring locking surface 214, so as to frictionally hold the case cover 12 at another folding angle A. Thus, when closing the case cover 12, the mutual friction between the locking surfaces 214 and the driving surfaces 222 also exists so as to prevent the case cover 12 from being accidentally dropped down, which may snap on the user's fingers.

Figure 7:
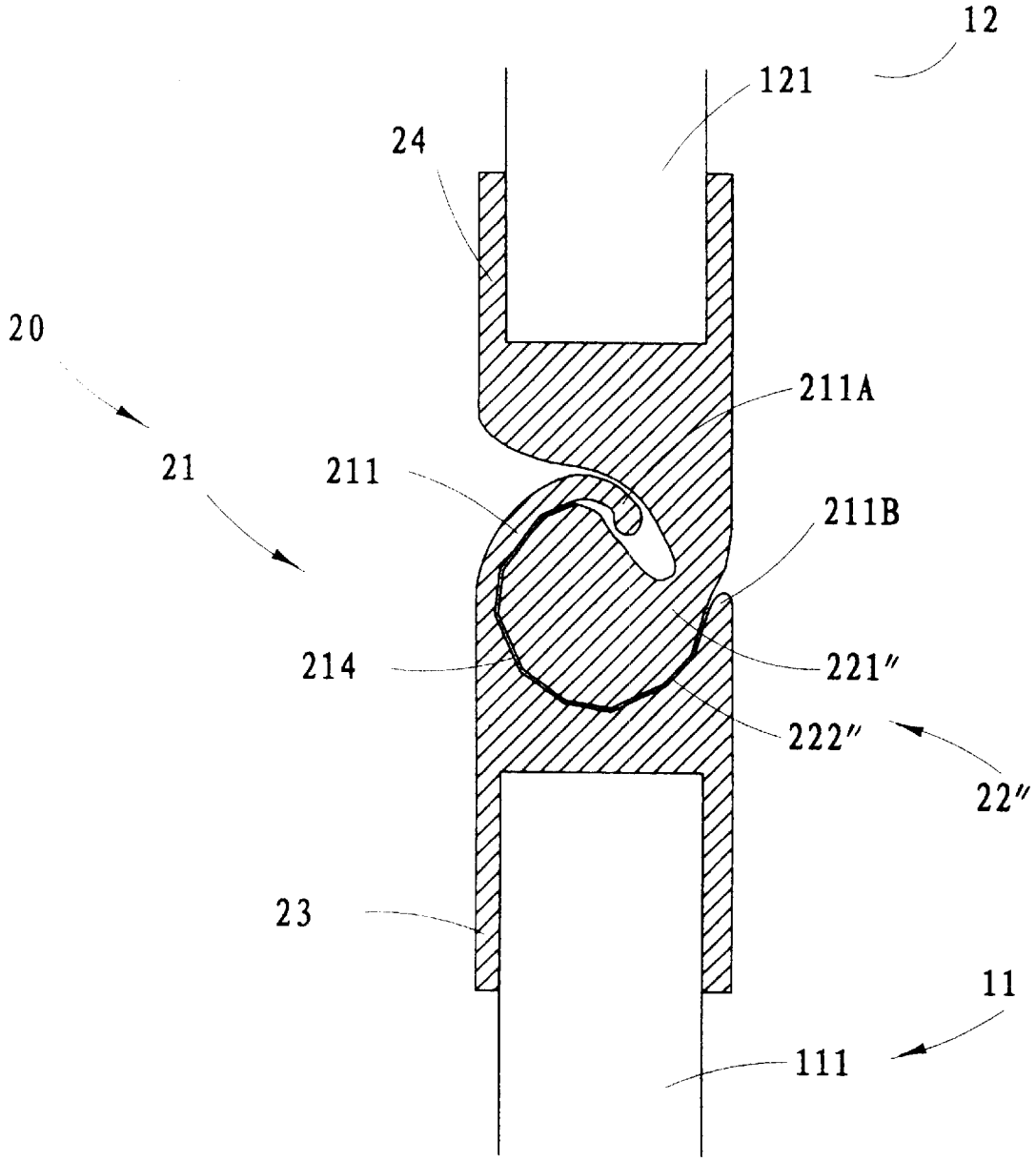
FIG. 7 illustrated an alternative mode of a pivot member of the case structure according to the above preferred embodiment of the present invention.

Referring to FIG. 7, an alternative mode of the pivot arm 221' according to the preferred embodiment of the present invention is illustrated wherein the pivot arm 221' has a rod shaped instead of the inversed C-shaped cross sectional structure such that the pivot arm 221' can rigidly support the case cover 12 in such a rotatably movable manner.

What is claimed is:

1. A case hinge structure adapted for installing on a case, comprising:

a case body having a box shape comprising a rear panel; and a case cover comprising a rear wall wherein said hinge structure is affixed between said rear panel of said case body and said rear wall of said case cover in such a manner that said case cover is adapted for pivotally folding from a closed position to an open position, wherein in said closed position, said case cover is tightly cover on top of said case body, and in said open position, said case cover is pivotally folded up at a predetermined folding angle with respect to said case body;

said hinge structure comprising:

a lower joint, which is upwardly extended from said rear panel of said case body, comprising a supporting arm having a C-shaped cross-section defining a mounting slot therein, wherein said lower joint further, comprises a plurality of locking surfaces integrally provided on said inner an inner circumferential surface of the supporting arm so as to form a polygon of said mounting slot; and an upper joint, which is downwardly extended from said rear wall of said case cover, having a pivot arm rotatably and coaxially received in said mounting slot of said lower joint in such a manner that a mutual friction is provided between an outer circumferential surface of said pivot arm and said inner circumferential surface; and of said supporting arm so as to frictionally adjust said folding angle of said case cover when opening said case, wherein said upper joint comprises a plurality of driving surfaces coaxially provided on said outer circumferential surface of said pivot arm wherein said driving surfaces are arranged to engage with said respective locking surfaces, so as to frictionally hold said case cover at said folding angle with respect to said case body.

2. A case hinge structure, as recited in claim 1, wherein said lower joint comprises an upper edge and a lower edge for urging against said upper joint in said open position and said closed position respectively, so as to limit said folding angle of said case cover.

3. A case hinge structure, as recited in claim 1, further comprising a first affixing means integrally extended from said lower joint and a second affixing means integrally extended from said upper joint, wherein said first and second affixing means each having a U-shaped cross section are securely clamped on edges of said rear panel and said rear wall respectively, so as to substantially affix said upper joint and said lower joint to said case cover and said case body respectively.

4. A case hinge structure, as recited in claim 2, further comprising a first affixing means integrally extended from said lower joint and a second affixing means integrally extended from said upper joint, wherein said first and second affixing means each having a U-shaped cross section are securely clamped on edges of said rear panel and said rear wall respectively, so as to substantially affix said upper joint and said lower joint to said case cover and said case body respectively.

5. A case hinge structure, as recited in claim 1, wherein said pivot arm of said upper joint having an inversed C-shaped cross section is rotatably received in said mounting slot, wherein an outer diameter of said pivot arm is slightly smaller than an inner diameter of said supporting arm.

6. A case hinge structure, as recited in claim 2, wherein said pivot arm of said upper joint having an inversed C-shaped cross section is rotatably received in said mounting slot, wherein an outer diameter of said pivot arm is slightly smaller than an inner diameter of said supporting arm.

7. A case hinge structure, as recited in claim 4, wherein said pivot arm of said upper joint having an inversed C-shaped cross section is rotatably received in said mounting slot, wherein an outer diameter of said pivot arm is slightly smaller than an inner diameter of said supporting arm.

8. A case hinge structure, as recited in claim 1, wherein said pivot arm of said upper joint having a rod shaped is rotatably received in said mounting slot, wherein an outer diameter of said pivot arm is slightly smaller than an inner diameter of said supporting arm.

9. A case hinge structure, as recited in claim 2, wherein said pivot arm of said upper joint having a rod shaped is rotatably received in said mounting slot, wherein an outer diameter of said pivot arm is slightly smaller than an inner diameter of said supporting arm.

10. A case hinge structure, as recited in claim 4, wherein said pivot arm of said upper joint having a rod shaped is rotatably received in said mounting slot, wherein an outer diameter of said pivot arm is slightly smaller than an inner diameter of said supporting arm.

11. A case hinge structure, as recited in claim 2, further comprising a pair of stoppers for coaxially mounting on two side ends of said lower joint when said upper joint is engaged therewith, so as to prevent a lateral movement of said pivot arm of said upper joint along said mounting slot.

12. A case hinge structure, as recited in claim 4, further comprising a pair of stoppers for coaxially mounting on two side ends of said lower joint when said upper joint is engaged therewith, so as to prevent a lateral movement of said pivot arm of said upper joint along said mounting slot.

13. A case hinge structure, as recited in claim 7, further comprising a pair of stoppers for coaxially mounting on two side ends of said lower joint when said upper joint is engaged therewith, so as to prevent a lateral movement of said pivot arm of said upper joint along said mounting slot.

14. A case hinge structure, as recited in claim 10, further comprising a pair of stoppers for coaxially mounting on two side ends of said lower joint when said upper joint is engaged therewith, so as to prevent a lateral movement of said pivot arm of said upper joint along said mounting slot.

* * * * *